US005276466A

United States Patent [19]

Tsukada et al.

[11] Patent Number: 5,276,466

[45] Date of Patent: Jan. 4, 1994

[54] RECORDING APPARATUS

[75] Inventors: Isao Tsukada, Kawasaki; Manabu Kanazawa, Yokohama; Shoushi Kikkawa, Kawasaki, all of Japan

[73] Assignee: Canon Kabushiki Kaisha, Tokyo, Japan

[21] Appl. No.: 851,908

[22] Filed: Mar. 16, 1992

[30] Foreign Application Priority Data

Mar. 18, 1991 [JP] Japan ..... 3-077302

[51] Int. Cl.[5] ..... B41J 23/00; B41J 2/01

[52] U.S. Cl. ..... 346/139 R; 74/57; 74/435; 74/404; 400/328; 346/140 R

[58] Field of Search ..... 400/328; 346/140; 74/57, 435, 404

[56] References Cited

U.S. PATENT DOCUMENTS

| | | | |
|---|---|---|---|
| 1,804,138 | 5/1931 | Yeider | 74/435 |
| 3,058,366 | 10/1962 | Matthews | 74/435 |
| 4,030,588 | 6/1977 | Hanagata et al. | 197/1 R |
| 4,313,124 | 1/1982 | Hara | 346/140 R |
| 4,345,262 | 8/1982 | Shirato et al. | 346/140 R |
| 4,459,600 | 7/1984 | Sato et al. | 346/140 R |
| 4,463,359 | 7/1984 | Ayata et al. | 346/1.1 |
| 4,558,333 | 12/1985 | Sugitani et al. | 346/140 R |
| 4,723,129 | 2/1988 | Endo et al. | 346/1.1 |
| 4,733,250 | 3/1988 | Nozaki et al. | 346/76 PH |
| 4,740,796 | 4/1988 | Endo et al. | 346/1.1 |
| 4,752,786 | 6/1988 | Inoue et al. | 346/139 R |
| 4,772,146 | 9/1988 | Saito et al. | 400/649 |
| 4,781,072 | 11/1988 | Tschudin | 74/435 |
| 4,920,258 | 4/1990 | Saito | 346/134 |
| 5,044,797 | 9/1991 | Walker et al. | 400/335 |

FOREIGN PATENT DOCUMENTS

| | | | |
|---|---|---|---|
| 0274266 | 7/1988 | European Pat. Off. . | |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 2069414 | 8/1981 | United Kingdom | 400/328 |
| 2140746 | 12/1984 | United Kingdom . | |
| 2206847 | 1/1989 | United Kingdom . | |

OTHER PUBLICATIONS

Zell, "Single Motor Drive" IBM Technical Disclosure Bulletin, vol. 26, No. 3B, Aug. 1983.

*Primary Examiner*—Benjamin R. Fuller
*Assistant Examiner*—N. Le
*Attorney, Agent, or Firm*—Fitzpatrick, Cella, Harper & Scinto

[57] ABSTRACT

Disclosed is a recording apparatus for recording information signals on a recording sheet. The apparatus includes a conveyance mechanism for conveying the sheet, a recording head reciprocating along the sheet for performing recording thereon, a driving power source for generating a driving force rotating in one direction which is used for reciprocating the recording head and for conveying the sheet by the conveyance mechanism, and a mechanism for inhibiting the conveyance of the sheet while the recording head is moving along the recording region of the sheet. The reciprocating operation of the recording head and the conveyance operation of the sheet are effected by a single motor.

18 Claims, 10 Drawing Sheets

RECORDING APPARATUS

BACKGROUND OF THE INVENTION

1. Field of the Invention

This invention relates to a serial-type recording apparatus which performs recording by reciprocating recording means along a recording medium and more particularly to a recording apparatus which performs the reciprocating operation of the recording means and the conveyance operation of the recording medium by means of a common motor.

2. Related Background Art

In years past, there has been known a serialtype small recording apparatus which performs recording by reciprocating a recording head along a recording sheet. A typical recording apparatus in which the reciprocating operation of the recording head and the conveyance operation of the recording sheet are carried out by use of a common motor has been constructed by independently disposing an advance groove and a return groove on a rod-like member so as to form a spiral groove thereon and coupling both ends of the spiral groove. The recording operation of such a recording apparatus has generally been made by inserting into the above-mentioned spiral groove a member projecting from a carriage on which the recording head is mounted and by causing the rod-like member to rotate in one direction so as to reciprocate the carriage.

In such a recording apparatus as specified above, it has been customarily practiced that the recording operation is limited to the advance and return operation and the operation process when the carriage returns is assigned to the conveyance operation of the recording sheet.

However, the conventional apparatus having such arrangements stated above includes the following problems to be solved.

(i) Since the advance and return grooves are provided on the same shaft by cutting a metallic shaft, the production costs increase.

(ii) Instead, it may be considered to fabricate the shaft through an injection molding process using a mold. However, the mold in this case must be configured in the form of split-type which can be separated radially and the generation of burrs on the planes to be separated after molding is unavoidable, and thus causes a hindrance to the stable sliding operation of the carriage. As a result, it has not yet been put into practice.

(iii) Since the conveyance of the recording sheet is generally carried out by transmitting the return motion of the carriage to cam members to actuate conveyance rollers, it is not possible to speed up the recording operation. If the motor is forcibly driven at higher speeds in order to speed up the recording operation, it would pose various problems such as noises and durability.

SUMMARY OF THE INVENTION

It is, therefore, an object of the present invention to provide a recording apparatus having compact and simple mechanisms.

It is another object of the present invention to provide a recording apparatus which performs the serial movement of recording means and the conveyance of a recording medium by use of a driving force from a driving power source turning in one direction.

It is a further object of the present invention to provide a recording apparatus in which recording means is reciprocated along a recording medium using a revolving body provided with a single spiral groove.

It is a still further object of the present invention to provide a recording apparatus for performing recording on a recording medium including a conveyance mechanism for conveying the recording medium, recording means reciprocating along the recording medium for performing recording thereon, a driving power of source for generating a driving force rotating in one direction which is used for reciprocating the recording means and for conveying the recording medium by the conveyance mechanism, and a mechanism for inhibiting the conveyance of the recording medium while the recording means is moving along the recording region of the recording medium.

It is a still further object of the present invention to provide a recording apparatus for performing recording on a recording medium including recording means for performing recording on the recording medium, a conveyance mechanism for conveying the recording medium, a revolving body capable of rotating in both forward and reverse directions for reciprocating the recording means along the recording medium, a driving power source for generating a driving force turning in one direction, a first rotary member for transmitting the driving force from the driving power source, a second rotary member capable of assuming a state where it receives the driving force from the first rotary member and another state where it does not receive the driving force from the first rotary member, a third rotary member capable of assuming a state where it receives the driving force from the first rotary member and another state where it does not receive the driving force from the first rotary member, a first transmission route for transmitting as forward turning effect the driving force from the first rotary member to the revolving body via the second rotary member, a send transmission route for transmitting as reverse turning effect the driving force from the first rotary member to the revolving body via the second and third rotary members, and a selection mechanism for selecting either of the first or second transmission route.

It is still another object of the present invention to provide a recording apparatus including a recording means for performing recording on the recording medium, a conveyance mechanism for conveying the recording medium, a revolving body capable of rotating in both forward and reverse directions for reciprocating the recording means along the recording medium, a driving power source for driving the conveyance mechanism and the revolving body, a first rotary member for transmitting the driving force from the driving power source, a second rotary member capable of assuming a state where it receives the driving force from the first rotary member and another state where it does not receive the driving force from the first rotary member, a third rotary member capable of assuming a state where it receives the driving force from the rotary member and another state where it does not receive the driving force from the first rotary member, a first transmission route for transmitting as forward turning effect the driving force from the rotary member via the second rotary member, a second transmission route for transmitting as reverse turning effect the driving force from the first rotary member to the revolving body via the second and third rotary members, and a selection mechanism for selecting either of the first or second transmission route.

It is still a further object of the present invention to provide a recording apparatus for performing recording on a recording medium including recording means for performing recording on the recording medium, a conveyance mechanism for conveying the recording medium, a revolving body capable of rotating in both forward and reverse directions for reciprocating the recording means along the recording medium, a driving power source for generating a driving force rotating in one direction which is used for driving the conveyance mechanism and the revolving body, a first rotary member for transmitting the driving force from the driving power source and provided with a mechanism for inhibiting the conveyance of the recording medium while the recording means is moving along the recording region of the recording medium, a second rotary member capable of assuming a state where it receives the driving force from the first rotary member and another state where it does not receive the driving force from the first rotary member, a second rotary member capable of assuming a state where it receives the driving force from the first rotary member and another state where it does not receive the driving force from the first rotary member, a third rotary member capable of assuming a state where it receives the driving force from the first rotary member and another state where it does not receive the driving force from the first rotary member, a first transmission route for transmitting as forward turning effect the driving force from the first rotary member to the revolving body via the second rotary member, a second transmission route for transmitting as reverse turning effect the driving force from the first rotary member to the revolving body via the second and third rotary members, and a selection mechanism for selecting either of the first or second transmission route.

DETAILED DESCRIPTION OF THE PREFERRED EMBODIMENTS

Figure 1:
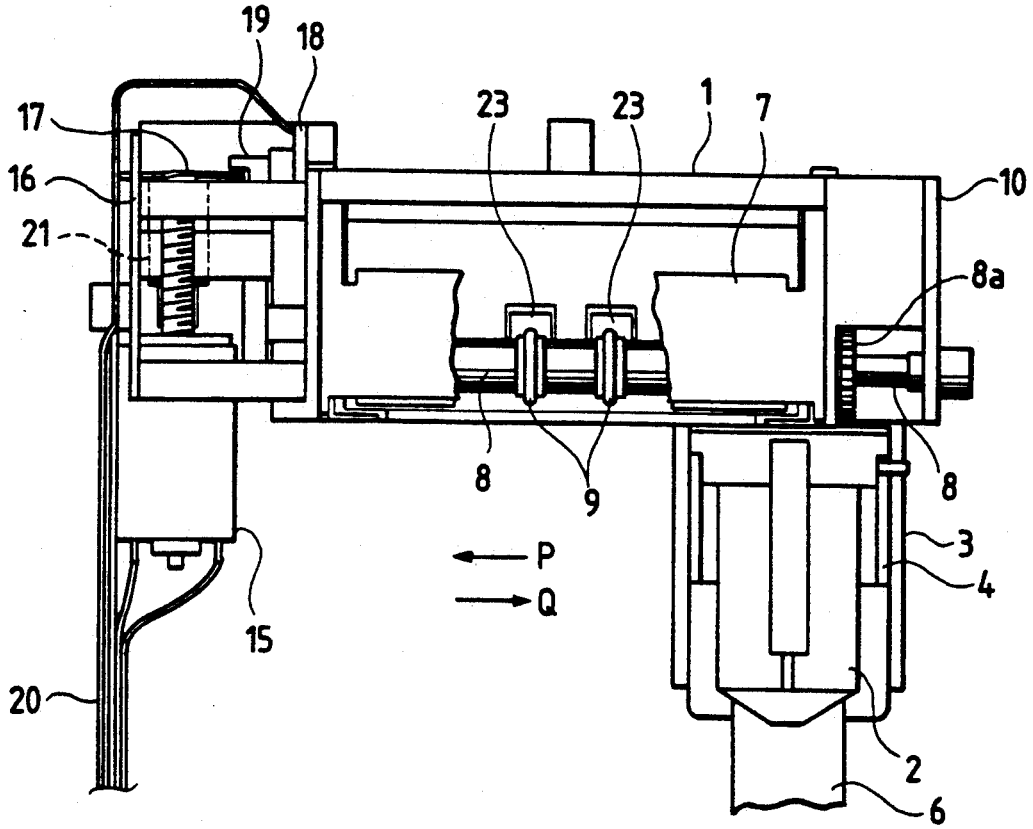
FIG. 1 is a plan view for explaining a recording apparatus relating to one embodiment of the present invention.
Figure 2:
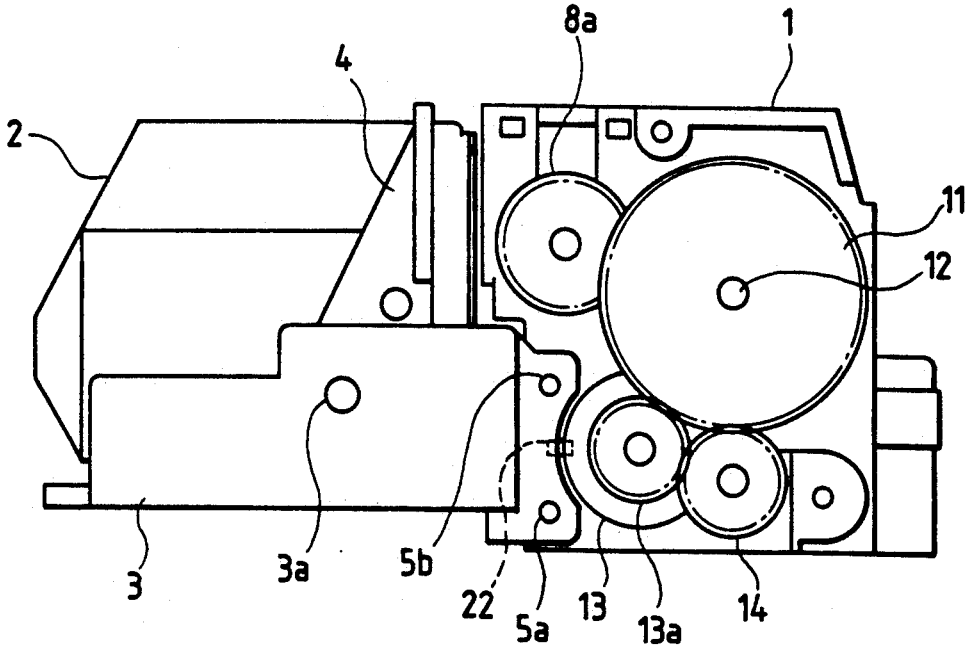
FIG. 2 is a right-hand side view of the recording apparatus.
Figure 3:
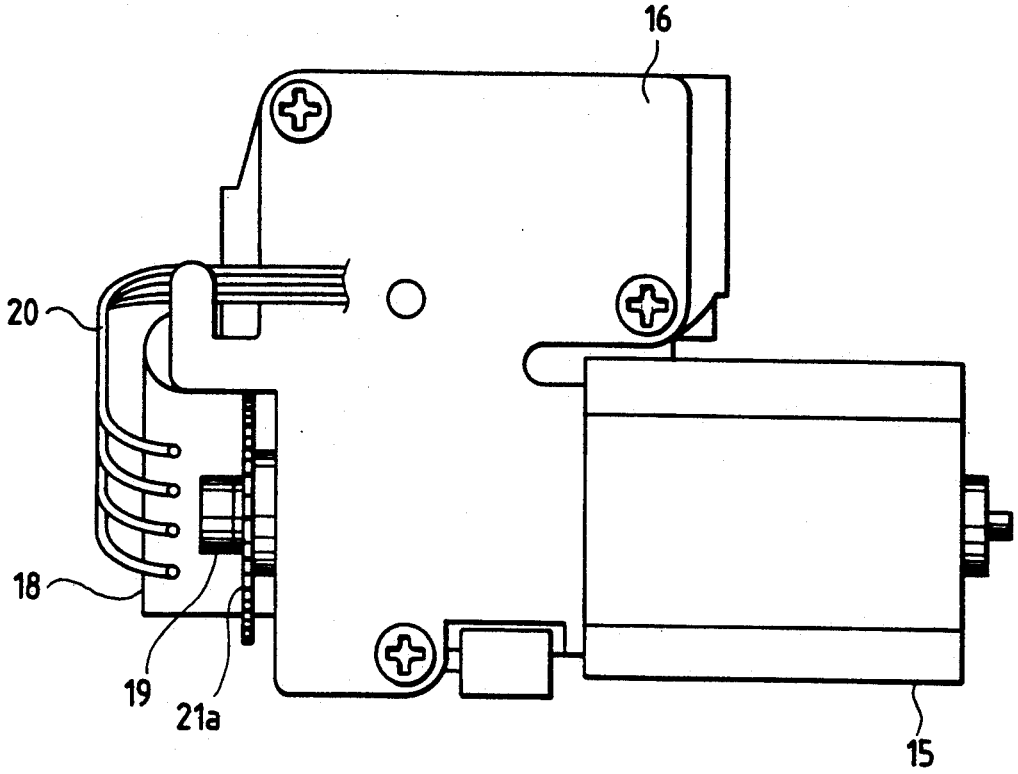
FIG. 3 is a left-hand side view of the recording apparatus.

Referring now to FIGS. 1 through 5, one preferred embodiment to which the present invention is applied will be hereinafter explained in detail. In particular, FIG. 1 is a plan view for a recording apparatus according to the present invention, FIG. 2 is a right-hand side view, and FIG. 3 is a left-hand side view of FIG. 1.

In FIG. 1, the reference numeral 1 designates a base frame used for forming an apparatus body, and a carriage 3 on which a recording head 2 constituting recording means is mounted is guided on the frame 1 so that the carriage can move in both directions indicated by arrows P and Q. In this preferred embodiment, an ink jet recording system which discharges ink from an ink discharge port upon application of energy in conformity with the signals to be recorded is used as the recording head 2. Specifically, there is provided means, for example, such as an electro-thermal conversion body or a laser beam, for generating thermal energy used as energy to discharge ink. Thus, a change in state of ink will be brought about by a change in thermal energy. According to this system, high-density as well as high-definition recording can be attained.

A set lever 4 is so mounted so that it is rotatable round a hole **3*a* provided in the carriage 3 as a center. The set lever 4 is used to fix the recording head 2 under pressure to a flexible cable 6** to be connected to an unshown drive circuit substrate.

In addition, the carriage 3 is supported by two sliding shafts **5*a* and 5*b* secured to the base frame 1 so that it can slide freely in the direction of the arrows P and Q in FIG. 1. Fixed to the carriage 3 is a projection pin 22 (FIG. 2) which is inserted into a streak of groove portion 13*b* (FIG. 6) formed in a screw member 13 corresponding to a revolving body to be described later and is used to convert the rotary motion of the screw member 13** into the rectilinear motion indicated by the arrows P and Q.

A platen 7 is also used as a guide for a recording sheet as a recording medium. A feed roller 8 for feeding the recording sheet is pivotably mounted by the base frame 1 and a right side plate 10, and a gear portion **8*a* is formed in place. Rubber rings 9 are secured at the middle portion of the feed roller 8*a*, and beneath each of the rings 9 a pinch roller 23 is disposed opposite thereto, and pressure is applied to the rubber ring 9 by a not-shown resilient shaft through the pinch roller 23. The recording sheet is inserted between the rubber ring 9 and the pinch roller 23 and conveyed in conformity with the amount of rotation of the feed roller 8**.

Referring now to FIG. 2, there is shown a right side view of the apparatus with the right side plate 10 removed. Reference numeral 11 shows a main gear corresponding to a first rotary member fixed to a shaft 12 which is rotatably connected to the base frame 1.

A reversing gear 14 corresponding to a second rotary member is rotatably supported by a shaft projected from the base frame 1. A screw member gear **13*a* corresponding to a third rotary member is integrally formed with the screw member 13** at the right end thereof.

Although the reversing gear 14 is always mated with the screw member gear 13*a*, the main gear 11 and the reversing gear 14 or the screw member gear 13*a* are so constructed that they transmit intermittently a drive force by means of a mechanism to be described later.

Figure 4:
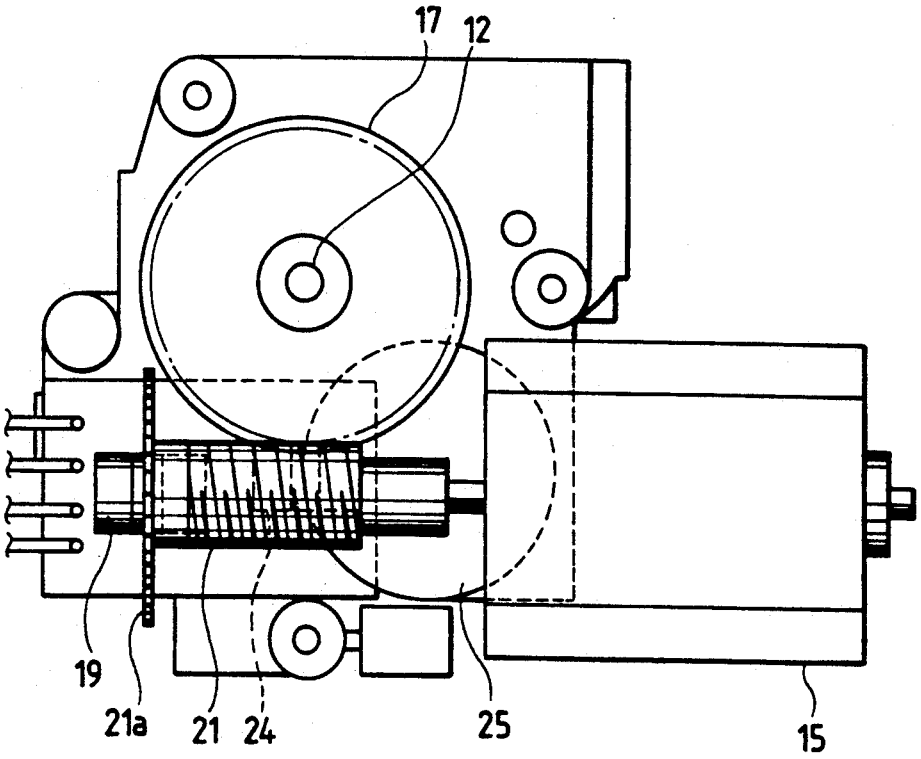
FIG. 4 is a left-hand side view of the recording apparatus with a side plate omitted.
Figure 5:
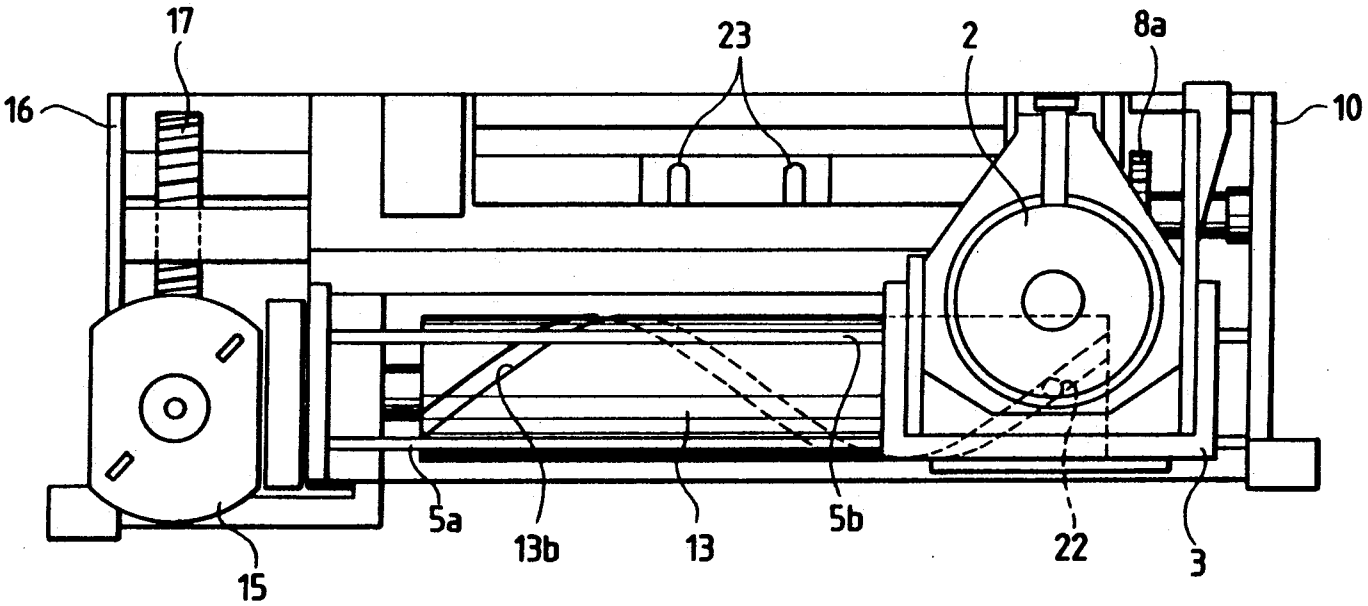
FIG. 5 is a front view of the recording apparatus.

Referring now to FIG. 4, there is shown a left side view of FIG. 3 with the left side plate removed. Reference numeral 15 shows a DC motor as a drive power source, and a worm gear 21 is fitted under pressure to a shaft of the motor. A disc-shaped encoder slit 21*a* is integrally formed with the worm gear 21 at the forward end thereof, and engaged into a recessed groove in a discharge signal detector 19. A wheel gear 17 is similarly secured to the shaft 12 as in the case of the main gear 11 and is always in engagement with the worm gear 21.

The discharge signal detector (transmission type photo detector) 19 and a recording start signal detector (transmission type photo detector) 24 are mounted on a PCB 18. The PCB 18 is connected to an unshown driving circuit by means of a flat cable 20.

Power Transmission System for Carriage

Next, a power transmission system for reciprocating the carriage 3 will be explained in detail.

Figure 6:
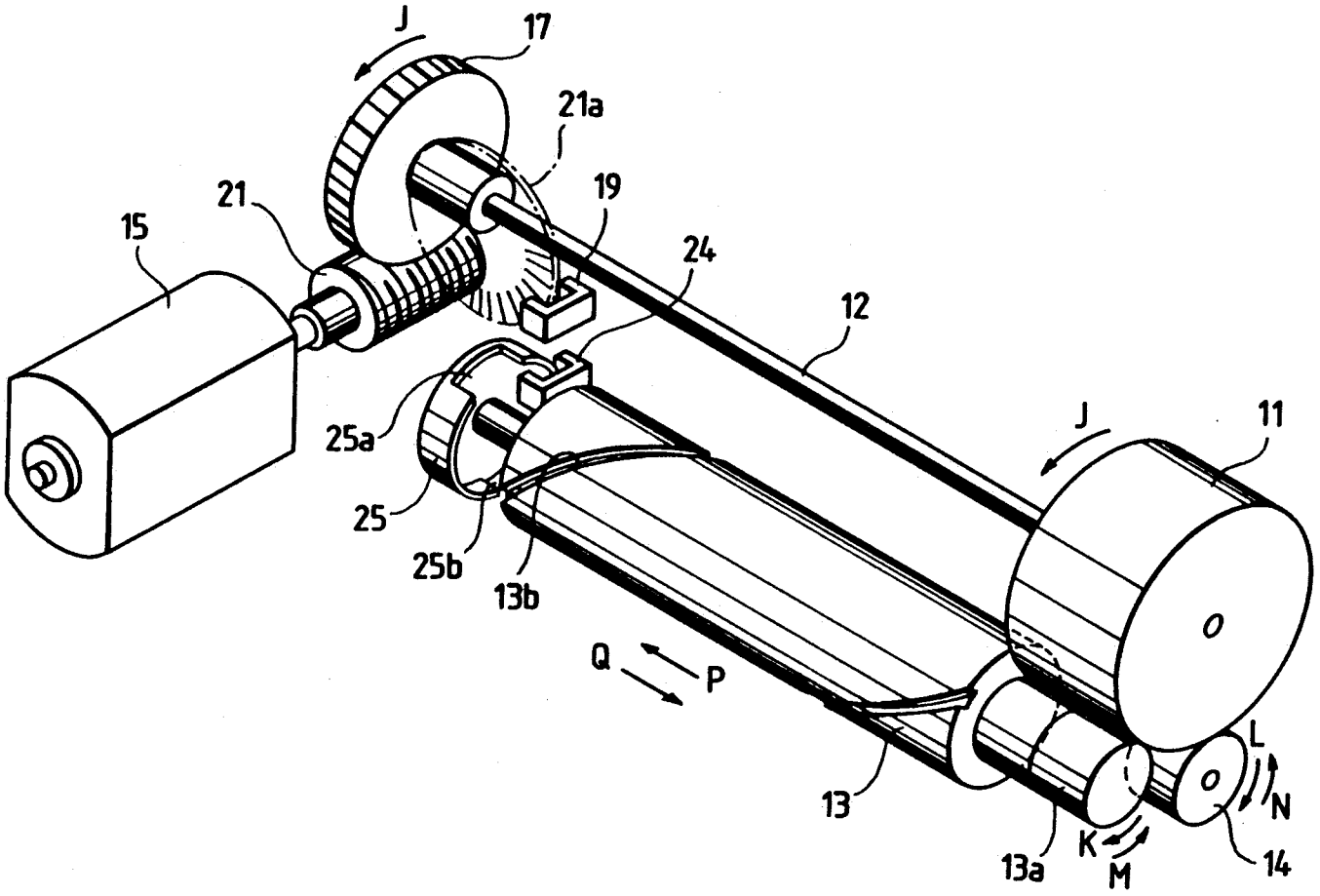
FIG. 6 is an explanatory diagram for a carriage driving system.

FIG. 6 shows a perspective view schematically illustrating the power transmission system relating to the reciprocal driving of the carriage, and the DC motor 15 is always rotated in one direction by the energization thereof, thereby permitting the wheel gear 17 to be always rotated in the direction of an arrow J through the worm gear 21, and thus the main gear 11 to be rotated in the same direction J through the shaft 12.

The power of the main gear 11 rotated at all times in the direction J is transmitted to the screw member gear 13*a* by way of the main gear 11 as explained above by means of a mechanism to be described later so as to turn the screw member 13 in a direction indicated by an arrow K. At this juncture, the carriage 3 is moved in the direction P.

Contrary to this, when the power is transmitted from the main gear 11 to the reversing gear 14, the reversing gear 14 is rotated in the direction L so that the screw member 13 is rotated in the direction M, due to the fact that the reversing gear 14 is always engaged with the screw member gear 13*a* as mentioned above. As the result, the carriage 3 is moved in the direction Q.

Next, the shapes of the main gear 11, the reversing gear 14 and the screw member gear 13*a* will be concretely explained by reference to FIGS. 7 through 9.

Figure 7A:
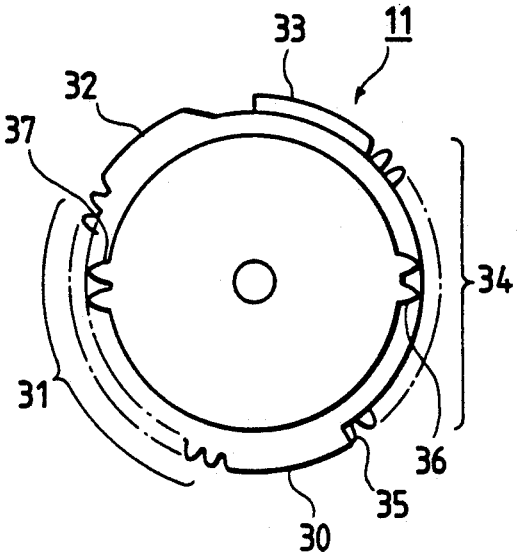
FIGS. 7A and 7B are explanatory diagrams for a main gear.
Figure 7B:
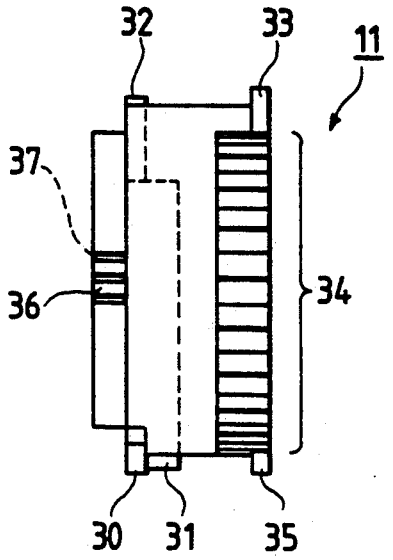

In FIGS. 7A and 7B, the gear 11 has a section opposed to the reversing gear 14, a section opposed to the screw member gear 13*a* and a section opposed to the feed roller gear 8*a*.

First of all, the section opposed to the screw member gear 13*a* comprises a gear portion 31 and cam portions 30 and 32 located at both ends thereof. The number of teeth in the gear portion 31 is set to 18 in this embodiment, but may be varied depending on the number of teeth in the reversing gear 14 and the screw member gear 13*a*, or rotation number of the screw member 13.

Next, the section opposed to the reversing gear 14 comprises a gear portion 34 and cam portions 33 and 35 located at both ends thereof, and set in the same configuration as the section opposed to the screw member gear 13*a* with the exception that the cam portions 33 and 35 are disposed opposite to toothabsent portions (40 or 42 in FIGS. 8 and 9 to be described later) on the reversing gear 14 and the screw member gear 13*a*. In addition, the section opposed to the feed roller gear 8*a* will be explained later.

Figure 8A:
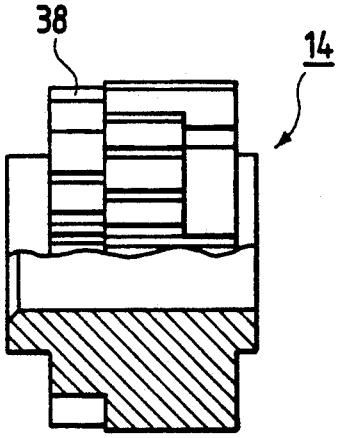
FIGS. 8A and 8B are explanatory diagrams for a reversing gear.
Figure 8B:
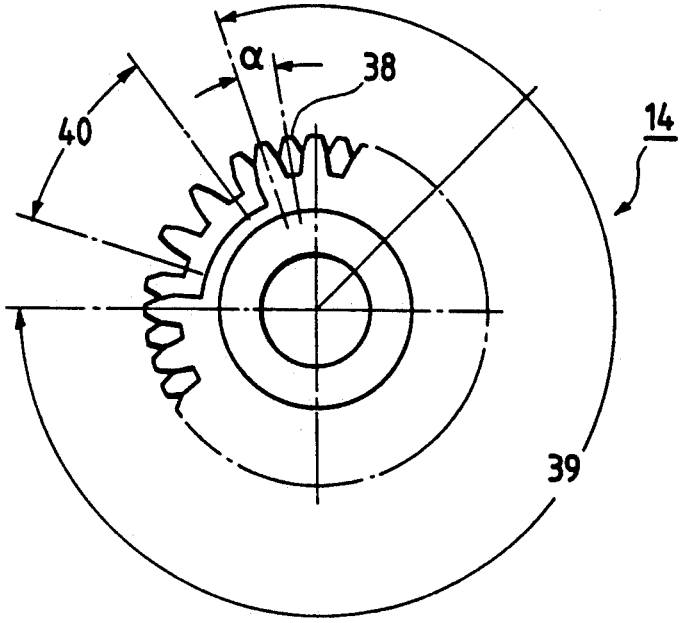

Referring now to FIGS. 8A and 8B, the reversing gear 14 is constituted by a whole-tooth portion 38 having teeth all around and a tooth-present portion having a partially tooth-absent portion (three teeth) 40. As discussed above, the tooth-absent portion 40 is located opposite to the cam portions 33 and 35 on the main gear 11.

In addition, the whole-tooth portion 38 and the tooth-present portion 39 are arranged to each other in such a manner that the apex of the tooth in the former is offset by a distance "$\alpha$" corresponding to half the tooth in the direction of rotation with respect to that of the latter.

As noted from the foregoing, the nearly middle position of the tooth-absent portion in the screw member gear 13*a* and the reversing gear 14 will be opposed to the rotational center direction of the main gear 11. As the result, the switching action between the transmission route for a driving force from the main gear 11 to the screw member gear 13*a* and the transmission route for a driving force from the main gear 11 to the reversing gear 14 can be effected smoothly.

Figure 9A:
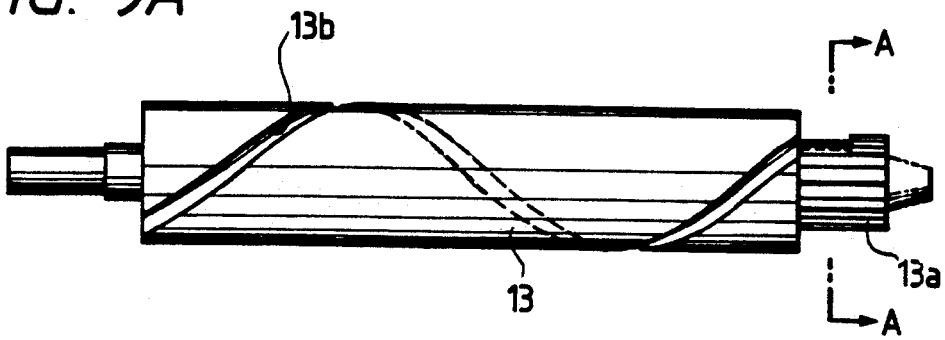
FIGS. 9A and 9B are explanatory diagrams for a screw gear.
Figure 9B:
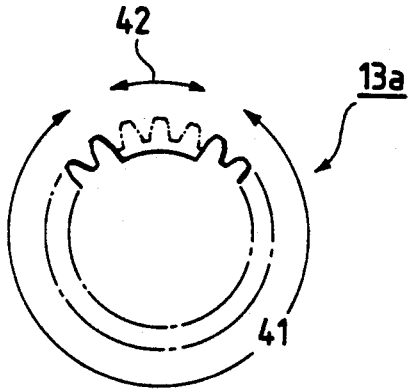

FIG. 9A is a view for explaining the screw member gear 13*a* and FIG. 9B is a sectional view taken along line A—A of FIG. 9A. The screw member gear 13*a* comprises a tooth-present portion 41 having a partially tooth-absent portion (three teeth) 42 just as in the case of the reversing gear 14. The toothabsent portion 42 will be positioned opposite to the cam portions 30 and 32 on the main gear 11.

Figure 10A:
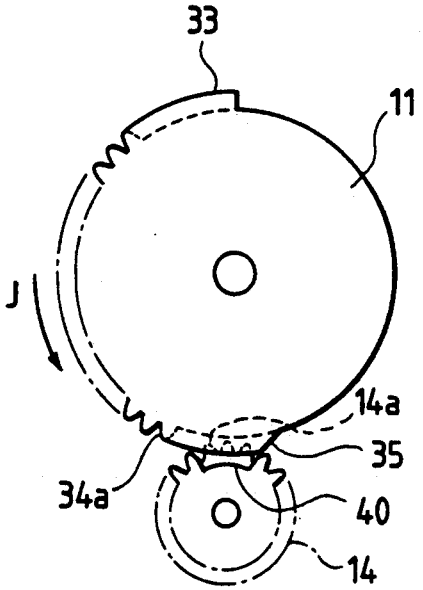
FIGS. 10A to 10D are diagrams for explaining the engagement and disengagement between the main gear and the reversing gear.
Figure 10B:
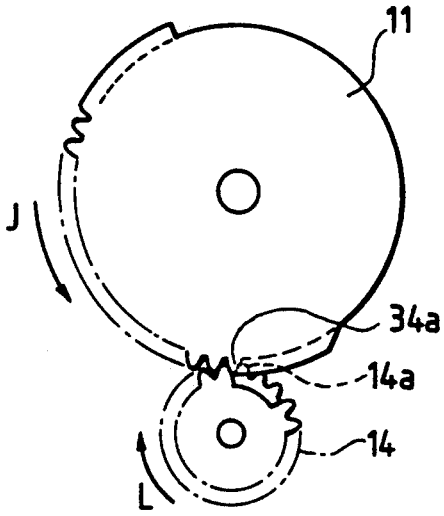

Operation will be explained concretely by referring to FIGS. 10A through 10D which are explanatory diagrams restricted to movements of the reversing gear opposing region of the main gear 11 and the reversing gear 14. In FIG. 10A, the cam portion 35 on the main gear 11 is placed in the tooth-absent portion 40 of the reversing gear 14 and at this time no rotational force is transmitted to the reversing gear 14. Thus the reversing gear 14 is maintained stopped even if the main gear 11 is rotated in the direction J. Then the main gear 11 is further rotated in the direction J so that a tooth-portion 34*a* on the main gear 11 mates with a tooth-portion 14*a* on the reversing gear 14 as shown in FIG. 10B and the reversing gear 14 is driven in the direction L.

Figure 10C:
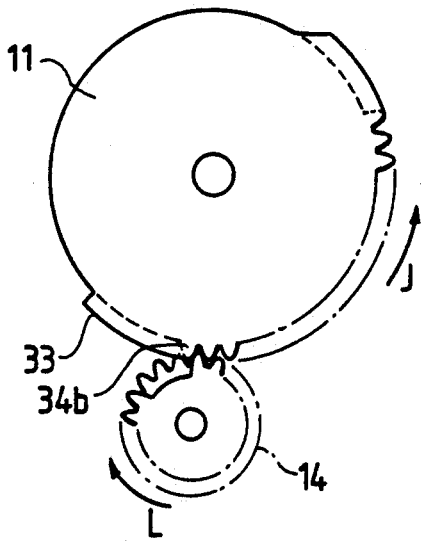
Figure 10D:
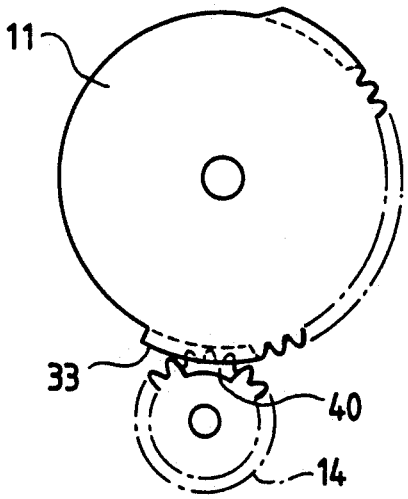

In FIG. 10C, the reversing gear 14 is still rotated in the direction L. When the engagement of the gear portion 34*b* is released by the setting of teeth on the main gear 11 as described above, the cam portion 33 enters the tooth-absent portion 40 after one revolution of the reversing gear 14 as shown in FIG. 10D, thus permitting the rotation of the reversing gear 14 to cease and then causing it to be locked. A similar operation as this will also be performed in mutual transmission operation between the screw member gear opposing region of the main gear 11 and the screw member gear 13*a*.

Since the tooth-present portion 38 (FIG. 8) of the reversing gear 14 is always in engagement with the screw member gear 13*a*, the operation of one revolution of the reversing gear 14 is transmitted to the screw member gear 13*a* to make one revolution of the screw member 13.

Figure 11:
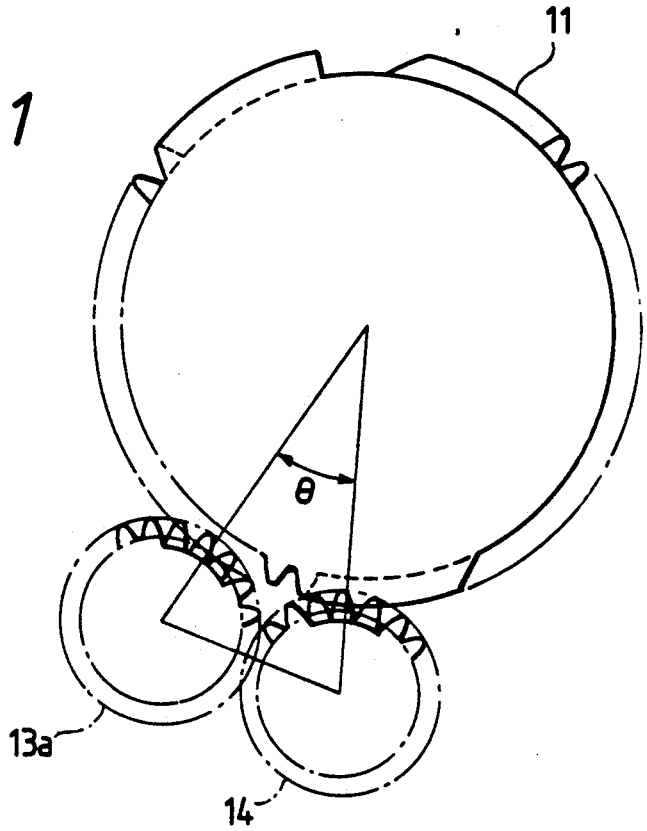
FIG. 11 is a diagram for explaining the relationship among the main, reversing and screw gears.

The opposing sections of the main gear 11 to the reversing gear 14 and to the screw member gear 13*a* are so set that the phase between them is offset substantially by 180° as shown in FIG. 7 (In reality, the above-mentioned phase 180° is further offset by an angle $\theta$ determined by the distance from the center of main gear 11 up to the center of the reversing gear 14 or the screw member gear 13*a* and the distance between the centers of the gears 14 and 13*a*, as shown in FIG. 11). As far as the positional relationship between the opposing region with respect to the reversing gear 14 and the screw member gear 13*a*, the condition in FIG. 10D corresponds to that of FIG. 10A.

Returning to FIG. 6, assuming that the recording head 2 is located at the extremely left end:

(i) If the main gear 11 turns in the range of 0° through 180° and the reversing gear 14 is rotated by one revolution in the direction L, the screw member gear 13*a* is thereby rotated by one revolution in the direction M. As the result of this process, the recording head 2 will be moved from the left end to the right end.

(ii) If the main gear 11 turns in the range of 180° through 360° and the screw member gear 13*a* is rotated by one revolution in the direction K, the reversing gear 14 is thereby rotated by one revolution in the direction N. In short, as the result of rotation of the screw member gear 13*a* in the direction K, the recording head 2 is moved from the right end to the left end.

Upon switching operation from (i) to (ii), and from (ii) to (i), each of the cam portions 32 and 35 is inserted into each of the tooth-absent portions of the reversing gear 14 and the screw member gear 13*a*, and the cam portion 30 and 33 enter the respective tooth-absent portions, thereby allowing each gear to be fixed. (Recording Sheet Conveyance Transmission System)

Next, the conveyance transmission system for the recording sheet will be explained. The recording sheet conveyance operation is performed by causing tooth-portions 36 and 37 integrally formed with the main gear 11 in FIG. 7 to intermittently drive the gear portion 8*a* on the feed roller 8 upon the rotary motion of the main gear 11. The tooth-portions 36 and 37 are offset by 180° in phase to each other in the vicinity where the carriage 3 is located at both sides by means of the screw member 13 as well as in the region where there is no effect on the recording operation of the recording head 2.

Figure 12:
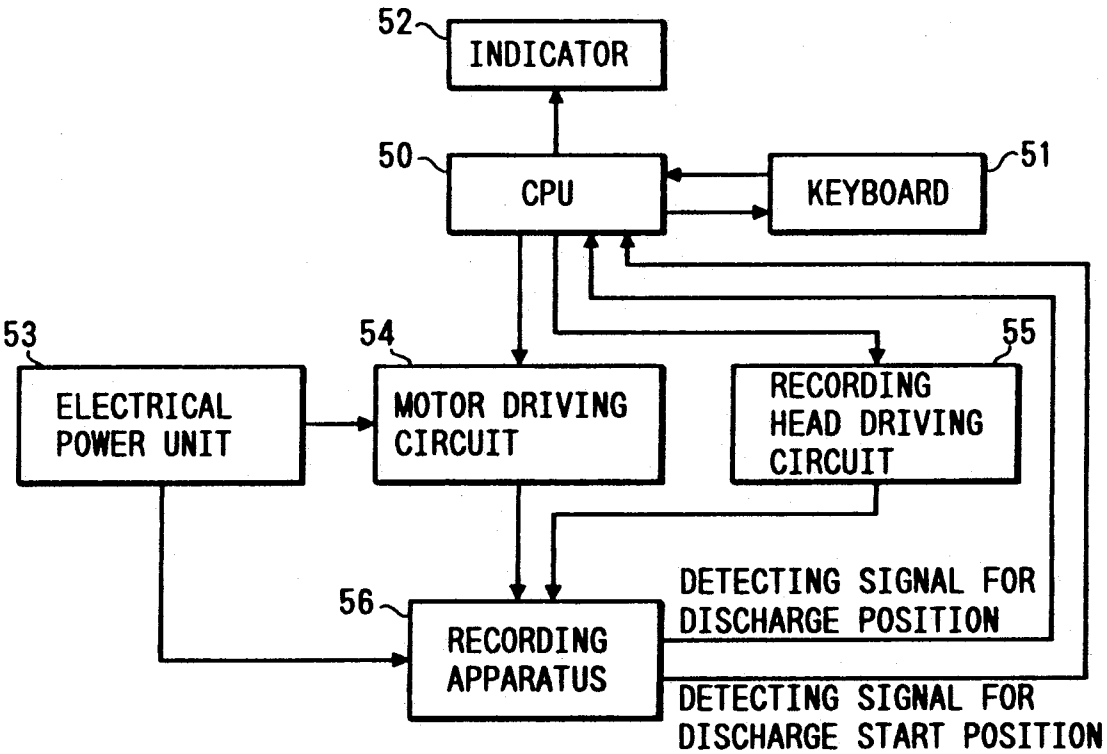
FIG. 12 is an electrical block diagram for explaining the operation of the recording apparatus.

Next, the recording operation of the present embodiment will be explained by referring to FIG. 12 which is a block diagram illustrating a constitution at the peripheral portion of the recording apparatus. The circuit diagram shown in FIG. 12 comprises a CPU 50, a keyboard 51, an indicator 52, an electrical power unit 53, a motor driving circuit 54, a recording head driving circuit 55, and a recording apparatus 56. As the signals applied from the recording apparatus 56 to the CPU 50, two kinds of signals are used, that is, a detecting signal for discharge position outputted from the discharge signal detector 19 and a detecting signal for discharge start position outputted from the recording start signal detector 24.

When the DC motor 15 is actuated upon application of voltage thereto, the detecting signals for discharge position are generated by the encoder slit disc 21*a* integrally formed with the worm gear 21. These signals will be generated in one-to-one correspondence with each dot row in a dot matrix.

Next, the carriage 3 starts to move in the direction P from the right end in FIG. 1, for example, due to the mutual operation among the main gear 11, the reversing gear 14 and the screw member gear 13*a*.

As more clearly understood by reverting momentarily to FIG. 6, the recording start position signals are generated by the slits 25*a* and 25*b* formed on the periphery of the encoder plate 25 which is secured to the end of the screw member 13 and rotated following the rotation thereof.

Figure 13:
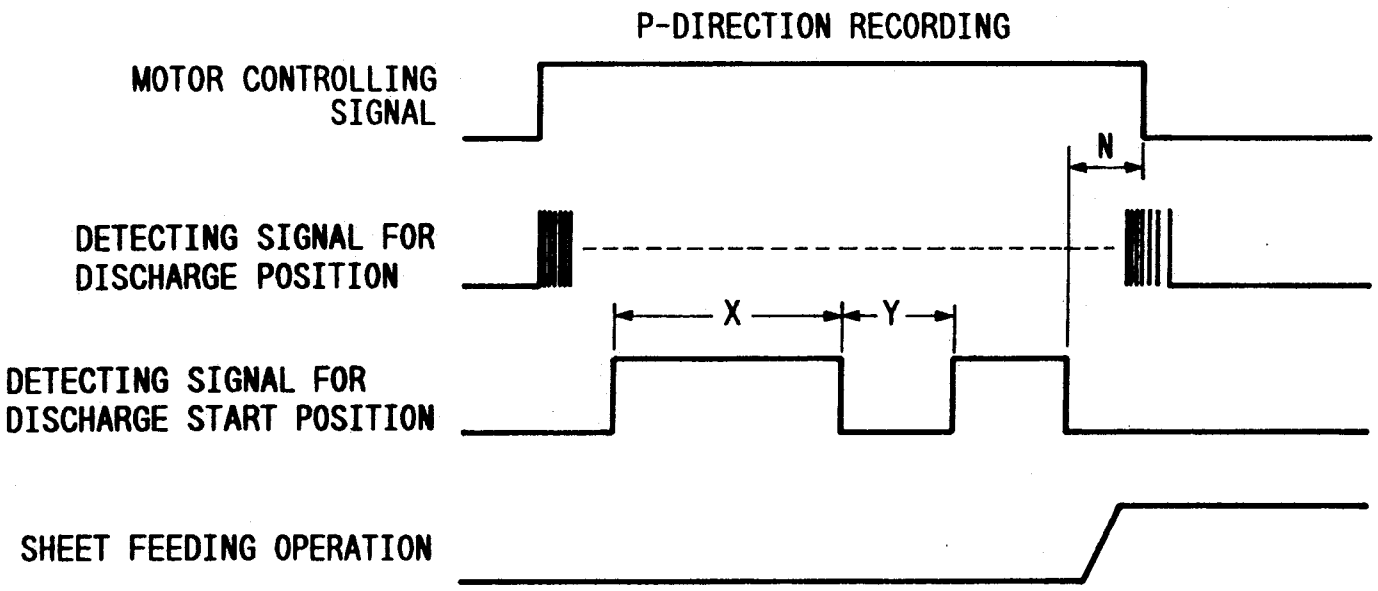
FIG. 13 is a timing chart illustrating a relationship between the recording operation during which the carriage is moved in one direction and the conveyance operation of a sheet.

CPU 50 directs the recording operation in the direction P (FIG. 1) by receiving the discharge position start signal and selectively outputting the recording signal in synchronism with the detection signal for discharge position. When the recording operation in the direction P ends, the CPU 50 counts the number of pulses of the discharge position detection signals and interrupts the energization of the motor 15 after N pulses. At this time, the carriage 3 will come to an immediate stop at the left end (FIG. 1) because the conveyance operation for the recording sheet has already been finished as described above. FIG. 13 indicates a timing chart for the above-mentioned operation.

The motor 15 is again started so that the screw member 13 is rotated in the opposite direction by the reversing mechanism to permit the carriage 3 to move to start in the direction Q from the left end of FIG. 1. Simultaneously with the start of the motor 15, the detection signals for discharge position are also generated.

When the detecting signals for discharge start position are generated through the rotation of the encoder plate 25, the CPU 50 directs the recording operation in the direction Q (FIG. 1) by selectively outputting the recording signals in synchronism with the generation of the above-mentioned detecting signals.

Figure 14:
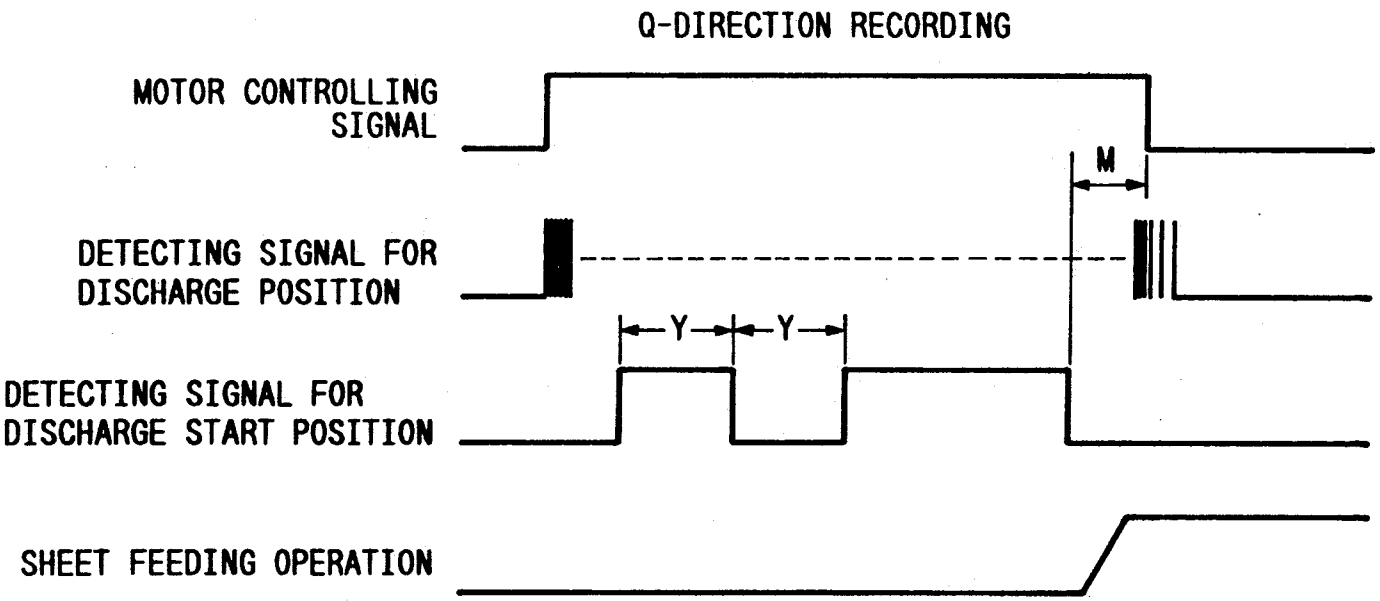
FIG. 14 is a timing chart illustrating a relationship between the recording operation during which the carriage is moved in the other direction and the conveyance operation of the sheet.

When the recording operation in the direction Q ends, the CPU 50 counts the number of pulses of the discharge position detection signals and interrupts the energization of the motor 15 after M pulses. At this time, the carriage 3 will come to an immediate stop at the right end (FIG. 1) because the conveyance operation for the recording sheet has already been finished as described above. FIG. 14 illustrates a timing chart for the above-mentioned operation.

The recording sheet is recorded by repeating the above-mentioned operation. Prior to the recording operation to the recording sheets, it is necessary for the CPU 50 to judge whether the carriage 3 is located at the left end or at the right end. This will be attained by energizing the motor 15 when power is applied to the system or when a specific key (all clear key, etc., for example) is depressed. Since the detecting signals for discharge start position are generated in two different waveforms corresponding to the shapes of the encoder plate 25 to discriminate between the directions P and Q, the CPU 50 can determine the direction of movement of the encoder plate 25 based on the different waveforms. In short, if it is X→Y as shown in FIG. 13, it corresponds to the travel in the direction P, and if it is Y→X as shown in FIG. 14, it corresponds to the direction Q.

Differences between the encoder pulses X and Y can be accurately judged by counting the number of pulses of the detecting signals for discharge position therebetween even when the rotational speed of the motor 15 varies.

Although the number of pulses from the end of recording in the directions P and Q up to the standstill of the motor 15 are assumed to be N and M, respectively, this pulse number is basically set to an identical value. However, they may be set to slightly different values depending on the differences in the loads.

Other Embodiments

Although, in the embodiment indicated above, the operation of the screw member gear 13*a* and the reversing gear 14 is shown as repetition of one-revolution operation, so far as it is restricted to within one revolution, it is basically possible to obtain any angle of rotation by selectively setting the number of teeth in each gear.

While the ink jet recording system is used as recording means in the embodiment discussed above, it is more preferable to perform the recording by energization of an electro-thermo conversion body in conformity with signals to be recorded and by permitting ink to be discharged from a discharge port as the result of the growth of bubbles yielded from heating beyond film boiling by the electro-thermo conversion body.

As typical examples including a representative construction and fundamental principles, U.S. Pat. No. 4,723,129 and No. 4,740,796 are known in the art. Systems disclosed in the above patents are applicable to both so-called on-demand type and continuous type. In particular, the on-demand type is more effective than others since the bubbles can be resultantly formed within the liquid in one-to-one correspondence with the driving signals by causing thermal energy to be generated by applying at least one driving signal inducing rapid temperature rise beyond nucleate boiling corresponding to the information to be recorded to the electro-thermal conversion body disposed in correspondence with a sheet or fluid path holding liquid (ink). In this case, such liquid is discharged due to the growth and contraction of bubbles by way of a discharge outlet. If the driving signals are provided in the form of pulses, the growth and contraction of bubbles can be conducted instantly, so that excellent discharge for the liquid can be achieved.

As the driving signals in the form of pulses, such signals as described in U.S. Pat. No. 4,463,359 and No. 4,345,262 are suited.

In addition, more excellent recording may be attained by employing conditions described in U.S. Pat. No. 4,313,124 disclosing an invention concerning a rate of temperature increase on a thermal working surface.

In the foregoing, one construction of the recording head has been described according to one preferable embodiment. It should be appreciated that other combinational arrangements (rectilinear liquid flow path or rectangular liquid flow path) comprising a discharge port, a fluid path and a thermo-electro conversion body and still another arrangement further comprising a thermal working section disposed in a bent region disclosed in U.S. Pat. No. 4,558,333 and No. 4,459,600 may also be involved in the present invention.

In addition, similar effect of the present invention can also be obtained by a construction in which a common slit is used as a discharge port to a plurality of electro-thermo conversion bodies as disclosed in Japanese Laid-Open Patent Application No. 59-123670 and another construction in which an opening absorbing a pressure wave of thermal energy is used as discharge port disclosed in Japanese Laid-open Patent Application No. 59-138461. In short, in the present invention, the recording operation can be effectively carried out independently of a construction of a recording head.

In addition to the serial-type recording head mentioned above, other types of recording heads such as a recording head fixed to a carriage, a freely exchangeable chip-type recording head adapted to be electrically connected to an apparatus body by mounting it on a carriage and to be capable of recovering ink from the apparatus body, or a cartridge type recording head in which an ink tank is integrally formed with the recording itself may be used as well.

From the point of view of making the effects of this invention more stable, it is preferable to add recovery means and auxiliary means for a recording head as a part of the recording apparatus. More specifically, capping means for the recording head, cleaning means, pressurizing or suction means, preliminary heating means comprising an electro-thermal conversion type element or another heating element or a combination thereof, and preliminary discharge mode effecting a discharge operation not relating to recording are included as auxiliary means.

For those skilled in the art, it will be appreciated that the kind and the number of recording heads to be mounted on a carriage will not be restricted to the embodiment shown and described above. For example, there is also included such a kind of recording head in which only one head corresponds to a monochromatic color, or a plurality of heads correspond to a plurality of ink each having different colors and densities. That is, the recording head according to the present invention is applicable not only to an apparatus having a recording mode using a predominant color such as black, etc., but also to an apparatus having a plurality of heads integrally formed and using multiple colors including different colors or full color by a compound color. On the other hand, in an ink jet recording system, it is common practice that the ink is temperature controlled within the range of 30°-70° C. to cause the viscosity of ink to be maintained within the range that insures stable discharge, so that any kind of ink may be used so long as it becomes liquid at the time of providing signals to be recorded. Besides, as ink usable in this invention, another ink having such a nature as to be liquefied only by thermal energy, such as one which is liquefied through the provision of thermal energy in correspondence with signals to be recorded, or one which starts to solidify immediately before it reaches a recording sheet, with the former attained by actively preventing a temperature rise due to thermal energy by consuming the temperature rise as thermal energy required to change from a solid state to a liquid state, and the latter attained by using ink which is solidified under a natural state for the purpose of preventing natural evaporation.

It is to be understood that the ink members in these cases may be made in such an opposing form that they are placed against an electro-thermal conversion body under conditions where they are held as liquid or solid in a through-hole or a recess of a porous sheet, as disclosed in Japanese Laid-Open Patent Application No. 54-56847 or No. 60-71260, and that the film boiling system as shown above is best suited for the respective inks described above.

As the ink jet recording apparatus described above, it can take the form of a copying machine combined with a reader or the like, or of a facsimile apparatus with transmission and reception functions, in addition to one which is used as an image output terminal for an information processor such as computer or the like.

Additionally, the recording means to be used in the present invention need not always be restricted to the ink jet recording system, various recording systems such as wire dot recording systems and thermal recording systems and others are also usable.

According to the preferred embodiment described above, since the unidirectional rotation of a driving power source can be converted into bidirectional rotation of the revolving body by way of the first, second and third rotary members, and the recording means is moved with the bidirectional rotation of the revolving body, remarkably lowered costs can be realized.

Due to the fact that bidirectional recording becomes possible, the recording speed may be increased without need to increase the number of revolutions of the driving power source. As a result, recording apparatuses with high efficiency can be achieved.

As described above in detail, according to the present invention, a recording apparatus capable of performing serial movement of recording means and conveyance of a recording medium by use of a driving force from a driving power source rotating in one direction can be obtained.

What is claimed is:

1. A recording mechanism for recording on a recording medium, said mechanism comprising:

a conveying mechanism for conveying the recording medium;

a rotary member for moving a recording section along the recording medium, the recording section for recording on the recording medium, said rotary member for rotating in a forward direction and a reverse direction;

a first rotating member for transmitting a rotation movement from a drive source in one direction;

a second rotating member operable in a state of receiving the rotation movement transmitted from said first rotating member and a state of not receiving the rotation movement transmitted from said first rotating member; and a third rotating member operable in a state of receiving the rotation movement transmitted from said first rotating member and a state of not receiving the rotation movement transmitted from said first rotating member, wherein a first transmitting route comprises transmitting the rotation movement from said first rotating member through said second rotating member to said rotary member as a rotation movement in the forward direction, and a second transmitting route comprises transmitting the rotation movement from said first rotating member through said second rotating member and said third rotating member to said rotary member as a rotation movement in the reverse direction.

2. A recording mechanism according to claim 1, wherein said first rotating member rotates in only one direction by the rotation movement from the drive source, which rotates in only one direction.

3. A recording mechanism according to claim 1, wherein when said second rotating member receives the rotation movement transmitted from said first rotating member, said third rotating member does not receive the rotation movement transmitted from said first rotating member.

4. A recording mechanism according to claim 1, wherein when said third rotating member receives the rotation movement transmitted from said first rotating member, said second rotating member does not receive the rotation movement transmitted from said first rotating member.

5. A recording mechanism according to claim 1, wherein said recording section is held in a carriage and reciprocally moves by rotation of said rotary member in said forward direction and said reverse direction in response to an engagement between at least a pin of said carriage and a screw groove of said rotary member.

6. A recording mechanism according to claim 1, wherein when said second rotating member and said third rotating member do not receive the rotation movement transmitted from said first rotating member, said first rotating member applies a drive force to said conveying mechanism for conveyance of the recording medium.

7. A recording mechanism according to claim 1, wherein said recording section comprises an ink jet recording head provided with an electrothermal converting element and said recording head discharges ink by using thermal energy generated upon energization of said electrothermal converting element.

8. A recording mechanism according to claim 1, wherein the drive source drives said conveying mechanism and said rotary member.

9. A recording mechanism according to claim 1, wherein the drive source comprises a DC motor.

10. A recording mechanism for recording on a recording medium, said mechanism comprising:

a conveying mechanism for conveying the recording medium;

a rotary member for moving a recording section along the recording medium, the recording section for recording on the recording medium, said rotary member for rotating in a forward direction and a reverse direction;

a drive source for generating a rotation movement in one direction;

a first rotating member for transmitting the rotation movement from said drive force in one direction;

a second rotating member operable in a state of receiving the rotation movement transmitted from said first rotating member and a state of not receiving the rotation movement transmitted from said first rotating member; and a third rotating member operable in a state of receiving the rotation movement transmitted from said first rotating member and a state of not receiving the rotation movement transmitted from said first rotating member, wherein a first transmitting route comprises transmitting the rotation movement from said first rotating member through said second rotating member to said rotary member as a rotation movement in the forward direction, and a second transmitting route comprises transmitting the rotation movement from said first rotating member through said second rotating member and said third rotating member to said rotary member as a rotation movement in the reverse direction.

11. A recording mechanism according to claim 10, wherein said first rotating member rotates in only one direction by the rotation movement from said drive source, which rotates in only one direction.

12. A recording mechanism according to claim 10, wherein when said second rotating member receives the rotation movement transmitted from said first rotating member, said third rotating member does not receive the rotation movement transmitted from said first rotating member.

13. A recording mechanism according to claim 10, wherein when said third rotating member receives the rotation movement transmitted from said first rotating member, said second rotating member does not receive the rotation movement transmitted from said first rotating member.

14. A recording mechanism according to claim 10, wherein said recording section is held in a carriage and reciprocally moves by rotation of said rotary member in said forward direction and said reverse direction in response to an engagement between at least a pin of said carriage and a screw groove of said rotary member.

15. A recording mechanism according to claim 10, wherein when said second rotating member and said third rotating member do not receive the rotation movement transmitted from said first rotating member, said first rotating member applies a drive force to said conveying mechanism for conveyance of the recording medium.

16. A recording mechanism according to claim 10, wherein said recording section comprises an ink jet recording head provided with an electrothermal converting element and said recording head discharges ink by using thermal energy generated upon energization of said electrothermal converting element.

17. A recording mechanism according to claim 10, wherein said drive source drives said conveying mechanism and said rotary member.

18. A recording mechanism according to claim 10, wherein said drive source comprises a DC motor.

* * * * *

UNITED STATES PATENT AND TRADEMARK OFFICE

CERTIFICATE OF CORRECTION

PATENT NO. : 5,276,466

DATED : January 4, 1994

INVENTOR(S) : Isao TSUKADA, et al.

It is certified that error appears in the above-indentified patent and that said Letters Patent is hereby corrected as shown below:

COLUMN 1:

Line 14, "serialtype" should read --serial-type--;

Line 68, "recording" should read --a recording--.

COLUMN 4:

Line 54, "a not-" should read --an un- --.

COLUMN 5:

Line 67, "toothabsent" should read --tooth-absent--.

COLUMN 7:

Line 29, "fixed.(Re-" should read --fixed.--;

Line 30, "cording" should read --Recording--, and "System)" should read --System.--.

UNITED STATES PATENT AND TRADEMARK OFFICE

CERTIFICATE OF CORRECTION

PATENT NO. : 5,276,466 Page 2 of 3

DATED : January 4, 1994

INVENTOR(S) : Isao TSUKADA, et al.

It is certified that error appears in the above-indentified patent and that said Letters Patent is hereby corrected as shown below:

COLUMN 9:

Line 9, "electro-thermo" should read --electro-thermal--;
Line 13, "electro-thermo" should read --electro-thermal--;
Line 46, "thermo-electro" should read --electro-thermal--;
Line 50, "involved" should read --incorporated--;
Line 54, "thermo" should read --thermal--;
Line 57, "as" should read --as a--;
Line 58, "Laid-open" should read --Laid-Open--;
Line 67, "recovering" should read --receiving--.

COLUMN 10:

Line 21, "ink" should read --inks--;
Line 64, "system, various" should read --system. Various--.

UNITED STATES PATENT AND TRADEMARK OFFICE

CERTIFICATE OF CORRECTION

PATENT NO. : 5,276,466 Page 3 of 3

DATED : January 4, 1994

INVENTOR(S) : Isao TSUKADA, et al.

It is certified that error appears in the above-indentified patent and that said Letters Patent is hereby corrected as shown below:

COLUMN 11:

Line 39, "comprises" should read --is for--;
Line 44, "comprises" should read --is for--.

COLUMN 12:

Line 44, "comprises" should read --is for--;
Line 49, "comprises" should read --is for--.

Signed and Sealed this

First Day of November, 1994

Bruce Lehman

*Attest:*

BRUCE LEHMAN

*Attesting Officer*

*Commissioner of Patents and Trademarks*